United States Patent [19]

Marchesi

[11] Patent Number: 4,641,592

[45] Date of Patent: Feb. 10, 1987

[54] UPPER LOOPER PROVIDED WITH A HOLE AND USED FOR MAKING AN OVEREDGE STITCH WITH THREE THREADS IN SEWING MACHINES

[75] Inventor: Franco Marchesi, Pavia, Italy

[73] Assignee: Rockwell-Rimoldi S.p.A., Italy

[21] Appl. No.: 708,913

[22] Filed: Mar. 6, 1985

[30] Foreign Application Priority Data

Jul. 31, 1984 [IT] Italy ..... 22761/84[U]

[51] Int. Cl.[4] ..... D05B 57/06

[52] U.S. Cl. ..... 112/162; 112/270

[58] Field of Search ..... 112/162, 197, 199, 270

[56] References Cited

U.S. PATENT DOCUMENTS

| | | | |
|---|---|---|---|
| 408,009 | 7/1889 | Goodwin | 112/162 |
| 832,740 | 10/1906 | Maier | 112/162 |
| 1,334,651 | 3/1920 | DeVoe | 112/162 |
| 1,640,201 | 8/1927 | Maier | 112/162 |
| 4,252,072 | 2/1981 | Draghicchio et al. | 112/199 |

*Primary Examiner*—Wm. Carter Reynolds

[57] ABSTRACT

An upper looper for a three thread overedge stitch machine having a hole in its end and having a tip which is curved toward a lower looper to facilitate transfer of the thread of the lower looper onto the upper looper.

3 Claims, 11 Drawing Figures

UPPER LOOPER PROVIDED WITH A HOLE AND USED FOR MAKING AN OVEREDGE STITCH WITH THREE THREADS IN SEWING MACHINES

The present invention relates to an upper looper of substantially rectilinear form and provided with a hole for the thread to be used for making an overedge stitch with three threads in overlock sewing machines of the industrial type.

BACKGROUND OF THE INVENTION

As is known, the elements which are most actively involved in the operation of a sewing machine of the industrial type consist, in addition to the needle, of a lower looper which oscillates below the fabric being sewn and an upper looper which oscillates in opposite phase relative to the lower looper, on either side of the edge of the fabric itself. These basic elements can have different shapes and structures, depending on the stitches which must be made. In particular, it is possible to make stitches using two or three threads which are attached to the needle, lower looper and, if necessary, upper looper.

The present invention relates in particular to the formation of an overedge stitch with three threads, classified under No. 504 in the Federal Standard Catalog. Moreover the present invention relates in particular to the structure of the abovementioned upper looper which, in the case of this specific application, has attached to it a thread and is therefore provided with a hole at its active end, through which the thread itself passes. This thread cooperates with the thread of the needle and the thread of the lower looper so as to form the abovementioned stitch which, as can also be seen from the attached drawings, is a stitch arranged on either side of the edge of a fabric.

Moreover, it is worth noting that, for the purposes which come within the scope of the present invention, provision is made, obviously by way of example, for the use of fabrics with a relatively high thickness, where required. In the prior art, the abovementioned upper looper was substantially capable of performing the function for which it was assigned during formation of the stitch in question, but had numerous drawbacks which gave rise to the occasional loss of stitches and/or to an operating speed which was not particularly high. So as to overcome these drawbacks, the Applicants have devised new technical solutions which provide the upper looper with maximum reliability during operation. In particular, the present invention deals with the technical problem of how to transfer the thread of the lower looper onto the upper looper in question, in a constant and practical manner, when the latter is moving towards the fabric.

It is known that the trajectory of the upper looper is initially almost vertical and that, during this section of the trajectory, the upper looper moves towards the lower looper and inserts itself between the latter and the associated thread. Subsequently, so that the stitch can be formed correctly, the upper looper must allow the thread of the lower hook to run along its own blade. Sometimes, however, it may happen that the thread of the lower hook gets caught on the front part of the upper hook, instead of running along the blade of the latter. Furthermore the rectilinear profile of the upper looper allows, under some unfavorable circumstances, an excessive running of said thread of the lower looper, after the first impact on said tip, far beyond the blade and up to the shank. This happens, in general, on account of the abovementioned trajectories of the said upper looper and owing to the specific technical and dimensional properties of the blade of the upper looper itself. The general aim of the present invention is to design an upper looper provided with a hole, which is able to overcome the abovementioned drawback, whilst fulfilling the said technical function, and also improve the reliability and operating precision of the upper looper. Within the context of this general aim, an important object of the present invention is to design an upper looper provided with a hole and with a structure which is particularly simple and easily produced by the industries in the sector.

These and other objects which will become clearer below, are substantially achieved by means of an upper looper of substantially rectilinear form and provided with a hole and used for making an overedge stitch with three threads in overlock sewing machines of the industrial type, wherein said looper comprises, at its end provided with a hole, a tip which is curved in the direction of the lower looper, a rounded and bulged projection adjoining the said curved tip, which rounded and bulged projection faces the stitches already formed and is provided, on its upper edge, which an inclined chamfer adapted to facilitate the transferring of the thread from the lower looper onto said upper looper, and wherein the substantially rectilinear profile of said upper looper is interrupted by a substantially vertical and upwardly projecting lug designed to define a guide and stop member for said thread of the lower looper; said lug being disposed substantially midway between the blade and the shank of said upper looper.

DESCRIPTION OF THE DRAWINGS

Further characteristic features and advantages will become clearer from the description of a preferred embodiment of the invention, illustrated by way of example in the attached drawings in which.

DESCRIPTION OF THE INVENTION

Figure 1:
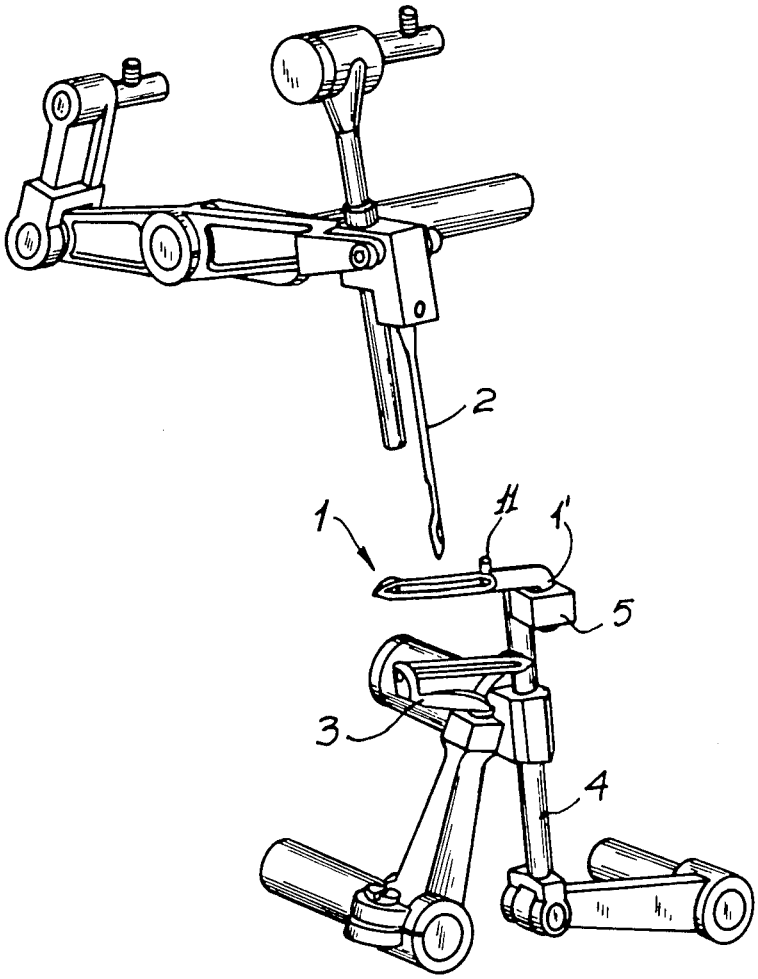
FIG. 1 shows a perspective view of all the elements which are most directly involved in the formation of the overedge stitch with three threads and shows an upper looper provided with a hole and with a perpendicular mounting shank.
Figure 3:
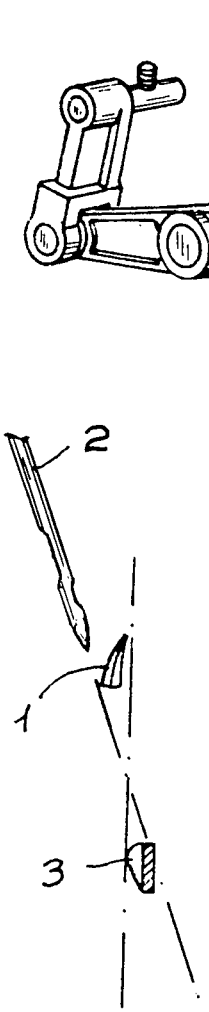
FIG. 3 shows, in schematic form, the trajectory of the needle in relation to the upper looper and the lower looper.
Figure 2:
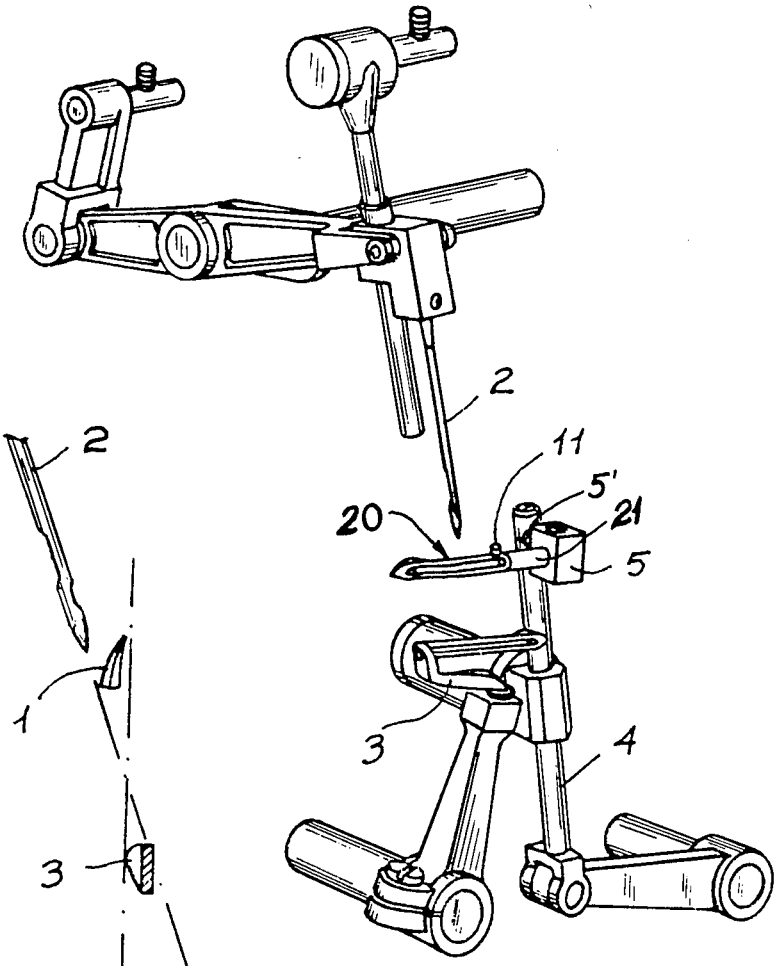
FIG. 2 shows in a perspective view the same elements as seen in FIG. 1 apart from the upper looper which has the mounting shank formed on the extension of the looper blade rather than extending downwardly as in the case of the mounting shank of the upper looper seen in FIG. 1, provided with a hole.

With reference to FIG. 1, the upper looper provided with a hole, which is the subject of this invention, is indicated in its entirety by the number 1 and can be of the type having a mounting shank disposed at right angles in order to allow in this case, a positioning of said looper adjustable in length. The loopers 1 and 3 in the needle 2 are associated with their respective kinematic mechanisms, known per se, designed to define the respective trajectories of movement shown in FIG. 3. Referring to FIG. 2, the upper looper 20 is of the same type as the upper looper seen in FIG. 1 but its shank 21 is obtained axially on the extension thereof, in order to allow, in this case, an angular positioning about its own logitudinal axis and a positioning in respect of height along this axis. Both said upper loopers 1 and 20 correspond to each other and it is therefore possible to refer to either of them when it is necessary to define their operating functions. In particular, the upper looper 1 is connected to an associated support rod 4 by means of a block 5 which is fixed to the rod 4 in a precisely determined position. Moreover, the upper looper 1 is engaged in the block 5, in a hole which is transverse relative to the rod 4 (FIG. 2) or in a hole which is parallel to the rod itself (FIG. 1). The two positions of the above mentioned hole are made possible by simply rotating the block 5 about its pivot $5^1$, only visible in FIG. 2, which is used for its mounting on the rod 4. In any case, simple insertion of the said looper into the said hole is sufficient for correct prepositioning of the same, the said hole having a precisely determined position and dimensions. As a result of this, amongst other things, an upper looper 1 provided with a hole can be very rapidly replaced with another type of looper, for example a "blind" upper looper, for forming an overedge stitch with two threads.

Figure 4:
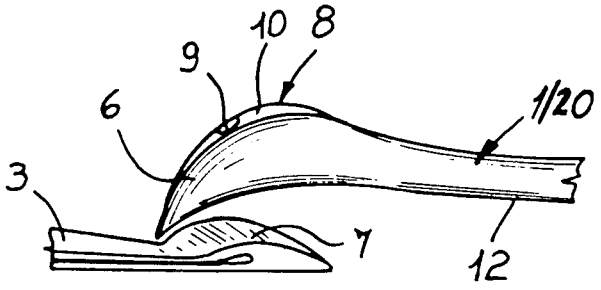
FIGS. 4 and 5 show, respectively, a plan view and bottom view of the active ends of the upper looper and lower looper, in the position where they are closest to each other.
Figure 5:
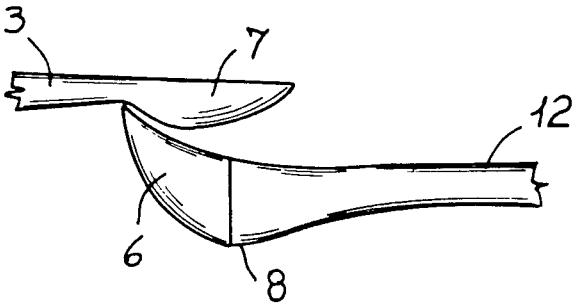
Figure 10:
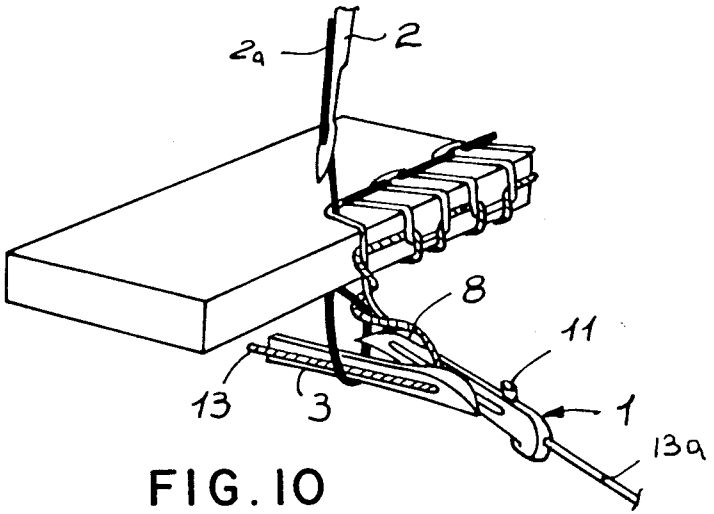
FIGS. 9, 10 and 11 show, in schematic form, a perspective view of certain stages during formation of an overedge stitch with three threads.
Figure 11:
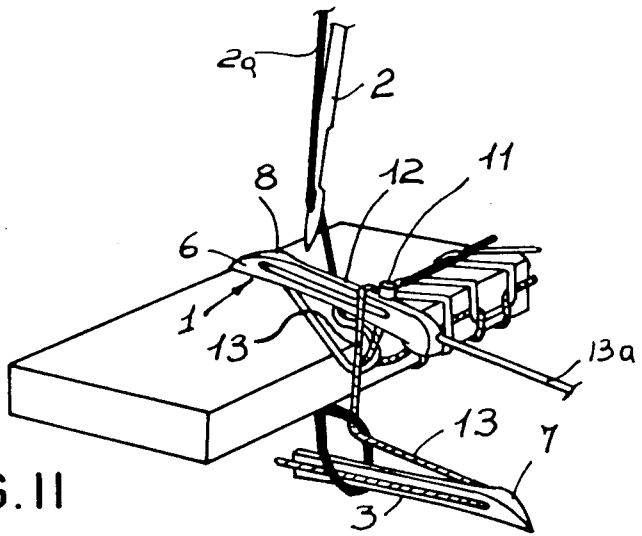

As FIGS. 4 and 5 show, the upper looper 1 has a tip 6 which is curved in the direction of the lower looper 3 and arranged substantially transversely relative to the latter. The lower looper 3 has, in turn, an end swelling which partially matches the shape of the tip 6. Moreover, as FIG. 8 also shows, the upper looper 1 has a rounded projection 8 adjoining the curved tip 6 and the hole 9 through which the thread passes. This rounded projection 8 is arranged on the opposite side to that of the upper looper 1 facing the lower looper 3. In practice, the rounded projection 8 faces the already formed stitches, as FIGS. 9 to 11 show.

Advantageously, provision is made for the rounded projection 8 to be provided with a chamfer 10 which has been made on the upper edge of the said projection and is inclined such that it causes tapering in an upwards direction, i.e., towards the upper edge of the looper 1.

Figure 6:
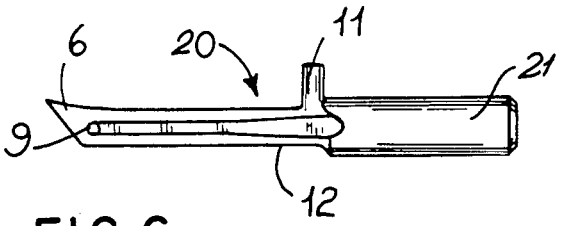
FIGS. 6, 7 and 8 show, respectively, an elevated, side and plan view of the structure of the upper looper provided with a hole, which is the subject of the present invention.
Figure 7:
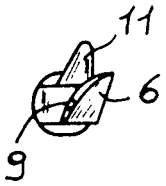
Figure 8:
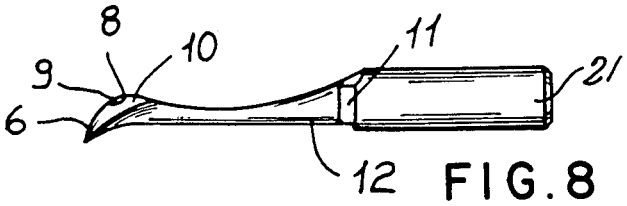
Figure 9:
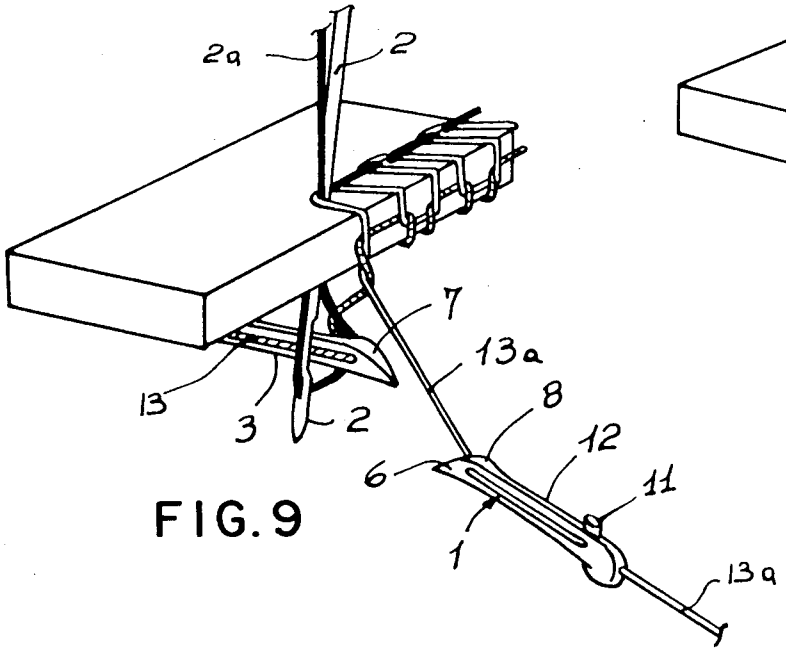

FIGS. 6, 7 and 8 show a further advantageous element formed on the upper hook 1 provided with a hole for the thread as the one, for example, identified by numeral 20 which is provided with the axial shank 21. Obviously, instead of this looper it is also possible to depict the upper looper seen in FIG. 1 because the loopers are identical to each other in forming stitches. At the rear of the said upper edge there is, in fact, provided a lug 11 projecting perpendicularly from the blade 12 of the said looper 1 and situated in the end zone of the blade itself. The lug 11 is provided to stop the thread 13 of the lower looper 3 when the latter runs along the blade 12 of the upper looper 1 which has its own thread **13*a* attached to it. Operation of the upper looper 1 according to the present invention does not differ, generally, from operation of the known loopers and is illustrated in FIGS. 9, 10 and 11**.

However, an original feature is that, as a result of the curved tip 6, the said upper looper 1 can be safely inserted between the lower looper 3 and the associated thread 13. Moreover, advantageously, the rounded projection 8 acts in such a way that the thread of the said upper looper 1 is separated substantially from the blade 12 when the thread itself is taut and the looper 1 is more or less in its highest raised position in the vicinity of the tip of the needle 2 (FIG. 11). The needle 2, together with its associated thread **2*a* is thus able to insert itself easily without friction, knocks or effort, between the upper looper 1 and the associated thread 13*a***.

In an original manner the chamfer 10 according to the invention enables the thread 13 of the lower looper 3 to run effortlessly along the upper looper 1 from the tip 6 to the blade 12 of the latter, as is shown in FIGS. 10 and 11. In practice, the chamfer 10 prevents any possible, but undesired pulling of the thread 13 and facilitates considerably its transfer.

The lug 11 acts as a stop for the said thread 13 and prevents the latter accidentally running along the blade 12 and onto the elements which support the upper looper 1. In fact, in this case, the thread 13 may become entangled and break.

It must also be pointed out that the chamfer 10 does not give rise to any problems of interference between the hole 9 and the needle 2 since, on account of the rounded projection 8, the thread **13*a* is separated from the shank 12 of the upper looper 1 sufficiently to enable correct positioning of the needle 2** and timing such that the said interference is unable to occur.

The invention thus achieves the proposed objects. It is emphasized that, although they are very simple and easily effected, the abovementioned variations in the structure of the upper looper 1 provided with a hole give rise to a substantial increase in the operating speed of a sewing machine as well as a high degree of reliability of the latter as regards transfer of the thread from the lower looper.

All of the detailed features can be replaced by technically equivalent elements. In practice, the materials used can be of any type and the dimensions of any magnitude, as required.

I claim:

1. An upper looper of substantially rectilinear form provided with a hole and used for making an overedge stitch with three threads in overlock sewing machines having also a needle and a lower looper, wherein said upper looper comprises, at its end provided with a hole, a tip which is curved in the direction of the lower looper, a rounded and bulged projection adjoining the said curved tip which rounded and bulged projection faces the stitches already formed and is provided, on its upper edge with an inclined chamfer adapted to facilitate the transferring of the thread from the lower looper onto the upper looper, and wherein the substantially rectilinear profile of the upper looper is interrupted by substantially vertical and upwardly projecting lug designed to define a guide and stop member for the thread of the lower looper, said lug being disposed suitably mid-way along the length of the upper looper.

2. A upper hook provided with a hole, as claimed in claim 1, wherein the said chamfer is made on said rounded projection to taper in the direction of the upper edge of the said hook.

3. Upper hook provided with a hole, as claimed in claim 1, wherein the said tip which is curved in the direction of the lower hook partially matches the shape of the end of the said lower hook, the said curved tip being arranged so as to be substantially transverse relative to the said lower hook.

* * * * *